US006203328B1

(12) United States Patent
Ortega et al.

(10) Patent No.: US 6,203,328 B1
(45) Date of Patent: Mar. 20, 2001

(54) CONNECTOR FOR ENGAGING END REGION OF CIRCUIT SUBSTRATE

(75) Inventors: Jose L. Ortega, Camp Hill; Douglas M. Johnescu, York; Michael V. Strawser, Lewisberry, all of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/302,621

(22) Filed: Apr. 30, 1999

(51) Int. Cl.[7] ..... H01R 9/09
(52) U.S. Cl. ..... 439/60
(58) Field of Search ..... 439/62, 108, 607, 439/92, 741, 743, 59, 60, 65

(56) References Cited

U.S. PATENT DOCUMENTS 4,710,133 * 12/1987 Linderman ..... 439/92
5,035,632 * 7/1991 Rudoy et al. ..... 439/108
5,156,554 * 10/1992 Rudoy et al. ..... 439/108

* cited by examiner

*Primary Examiner*—Neil Abrams
*Assistant Examiner*—J. F. Duverne
(74) *Attorney, Agent, or Firm*—Woodcock Washburn Kurtz Mackiewicz & Norris LLP

(57) ABSTRACT

A connector that acts as a power and signal link between a computer processor and a power source provides a short, compact signal path with the use of high conductivity contacts and flexible cable. A modularity connection scheme is used in which the connector comprises several assemblies. An exemplary connector comprises a first contact assembly, a second contact assembly, and a housing. The internal components of the connector consist of the first contact assembly and the second contact assembly. The first contact assembly is preferably a power contact assembly and comprises a pair of flexible contacts having contact areas. The second assembly is preferably an auxiliary contact assembly and comprises a flexible contact having contact area. The first assembly and the second assembly are inserted into the housing, and are thereby trapped by the housing surfaces to form the connector.

30 Claims, 17 Drawing Sheets

CONNECTOR FOR ENGAGING END REGION OF CIRCUIT SUBSTRATE

FIELD OF THE INVENTION

The present invention relates in general to electrical connectors. More particularly, the present invention relates to a structure for releasably connecting contacts of a circuit to conductive pads on a printed circuit board.

BACKGROUND OF THE INVENTION

In electrical arts, it is a common practice to use a connector to mechanically and electrically couple one printed circuit board (PCB) to another PCB. In such a practice, there has been an evolution towards placing electrical contacts closer and closer together while maintaining a high, constant stress between the electrical contact and the areas to be contacted. In electrical systems, flexible printed circuits are employed as electrical jumpers or cables for interconnecting rows of terminal pins or pads of PCBs. A connector, mounted to one or both ends of the jumper, is formed with a set of electrical receptacles or sockets which is designed to receive the terminal posts or contact the pads on the PCB.

A primary focus of manufacturers is to increase the circuit density associated with interconnecting the sub-assemblies and components found within their products. This leads to higher density modules, each requiring multiple interconnections to other modules. However, major problems with connectors having closely spaced contacts include the problems of cross-talk, lack of controlled impedance, and increased inductance.

Moreover, to minimize power drain, the computer industry desires the ability to power down a system when not in use and then "instantaneously" power up the system when needed. This combination of high current and fast front edge response requires that the power connector for these new computer systems must be able to handle high currents with minimal resistive losses and minimal inductive voltage spikes.

Although the art of connectors is well developed, there remain some problems inherent in this technology, particularly connectors having closely spaced contacts and include the problems of cross-talk, lack of controlled impedance, and increased inductance. Therefore, a need exists for a connector structure and assembly that reduces cross-talk, controls impedance, and reduces inductance as connector density increases.

SUMMARY OF THE INVENTION

The present invention is directed to a connector comprising: a first contact assembly comprising a first flexible contact and a second flexible contact, each flexible contact having a contact area towards one end of the flexible contact that is electrically connectable with associated electrically conductive pads on a circuit board; a second contact assembly comprising a flexible contact having a contact area at one end thereof for electrically connecting with an associated electrically conductive pad on the circuit board; and an outer housing for accepting the first contact assembly and the second contact assembly, the housing having an aperture at one end to receive the circuit board containing the electrically conductive pads.

According to one aspect of the present invention, each of the first and second flexible contacts comprises a flexible substrate carrying at least one electrical conductor on which the contact area is disposed. Preferably, the first and second flexible contacts are biased towards one another and the contact areas face one another.

In accordance with a further aspect of the present invention, the first contact assembly further comprises a mounting portion for securing the first and second flexible contacts, and each of the first and second flexible contacts comprises a bump that is used to secure the flexible contact to the mounting portion. Preferably, the first and second flexible contacts are sandwiched within the mounting portion.

In accordance with further aspects of the present invention, each of the first and second flexible contacts has an alignment hole to provide for alignment during fabrication. Moreover, each of the first and second flexible contacts is attached to a flexible cable at the end of the flexible contact opposite the contact area. A plurality of first flexible contacts can be in parallel with one another and a plurality of second flexible contacts can be in parallel with one another.

In accordance with further aspects of the present invention, the second contact assembly further comprises a housing, and the flexible contact in the second contact assembly has an undercut to trap the flexible contact in the housing. Preferably, the housing of the second contact assembly has a slot for receiving the first contact assembly to form a subassembly. The subassembly is then disposed within the outer housing.

Another embodiment within the scope of this invention includes a connector comprising: a first contact assembly comprising a first flexible contact and a second flexible contact, each flexible contact having a contact area towards one of the flexible contact that is electrically connectable with associated electrically conductive pads on a circuit board; a second contact assembly comprising a flexible contact having a contact area at one end thereof for electrically connecting with an associated electrically conductive pad on the circuit board; and an outer housing for accepting the first contact assembly and the second contact assembly, the outer housing having an aperture at one end to receive the circuit board containing electrically conductive pads and through holes along one surface through which the ends of the flexible contacts away from the contact areas extend perpendicularly.

According to another aspect of the present invention, the first and second flexible contacts are interleaved or are disposed in a side-by-side arrangement.

According to another aspect of the present invention, the contacts are releasably connectable to the circuit board via the through holes.

The foregoing and other aspects of the present invention will become apparent from the following detailed description of the invention when considered in conjunction with the accompanying drawings.

DESCRIPTION OF EXEMPLARY EMBODIMENTS AND BEST MODE

The present invention is directed to a connector that, for example, acts as a power and signal link between a computer processor and a power source. The connector provides a short, compact signal path with the use of high conductivity contacts and flexible cable (hereinafter also referred to as flex cable). Moreover, the present invention provides a modular connection scheme in which the connector comprises several assemblies. In accordance with the present invention, the connector assembly is easily accessible for the attachment of the flex cables.

Figure 1:
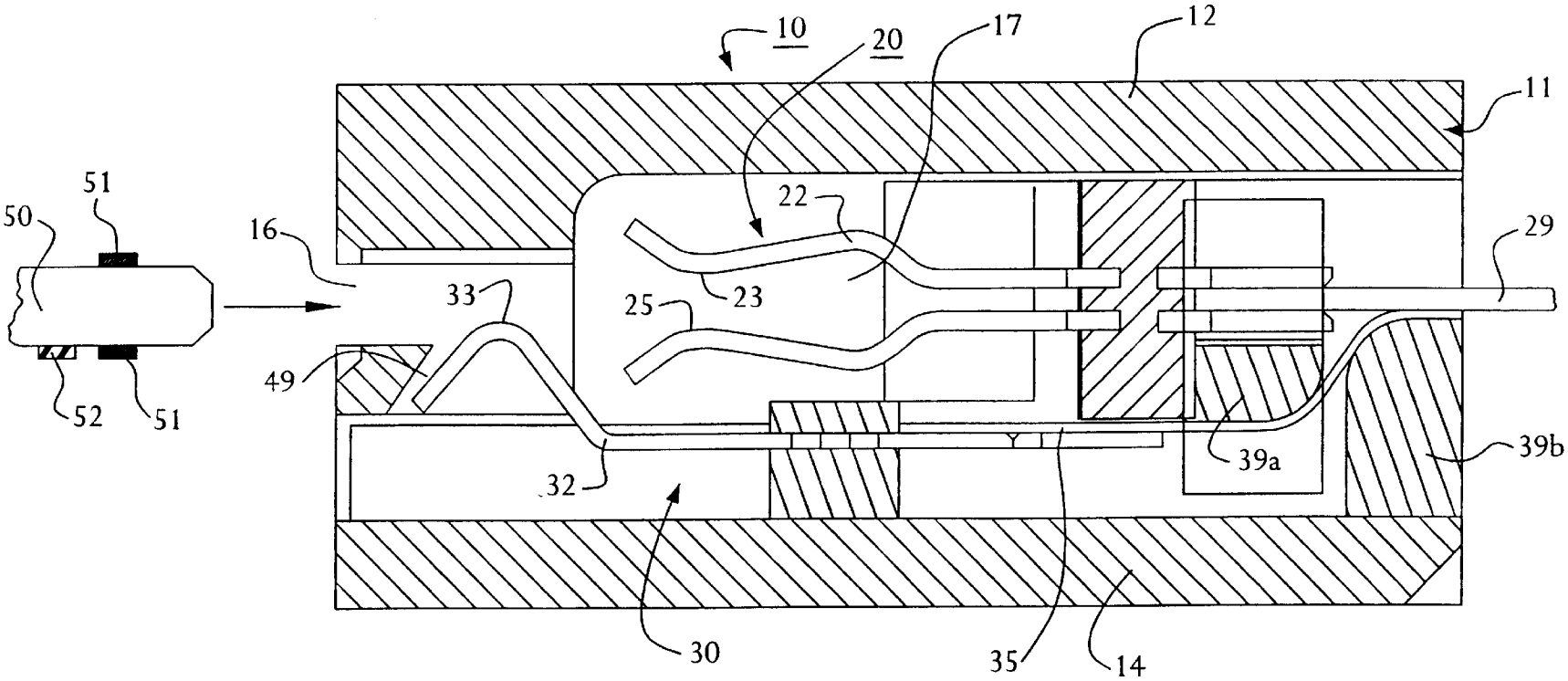
FIG. 1 is a cross-sectional view of an exemplary connector in accordance with the present invention.
Figure 2:
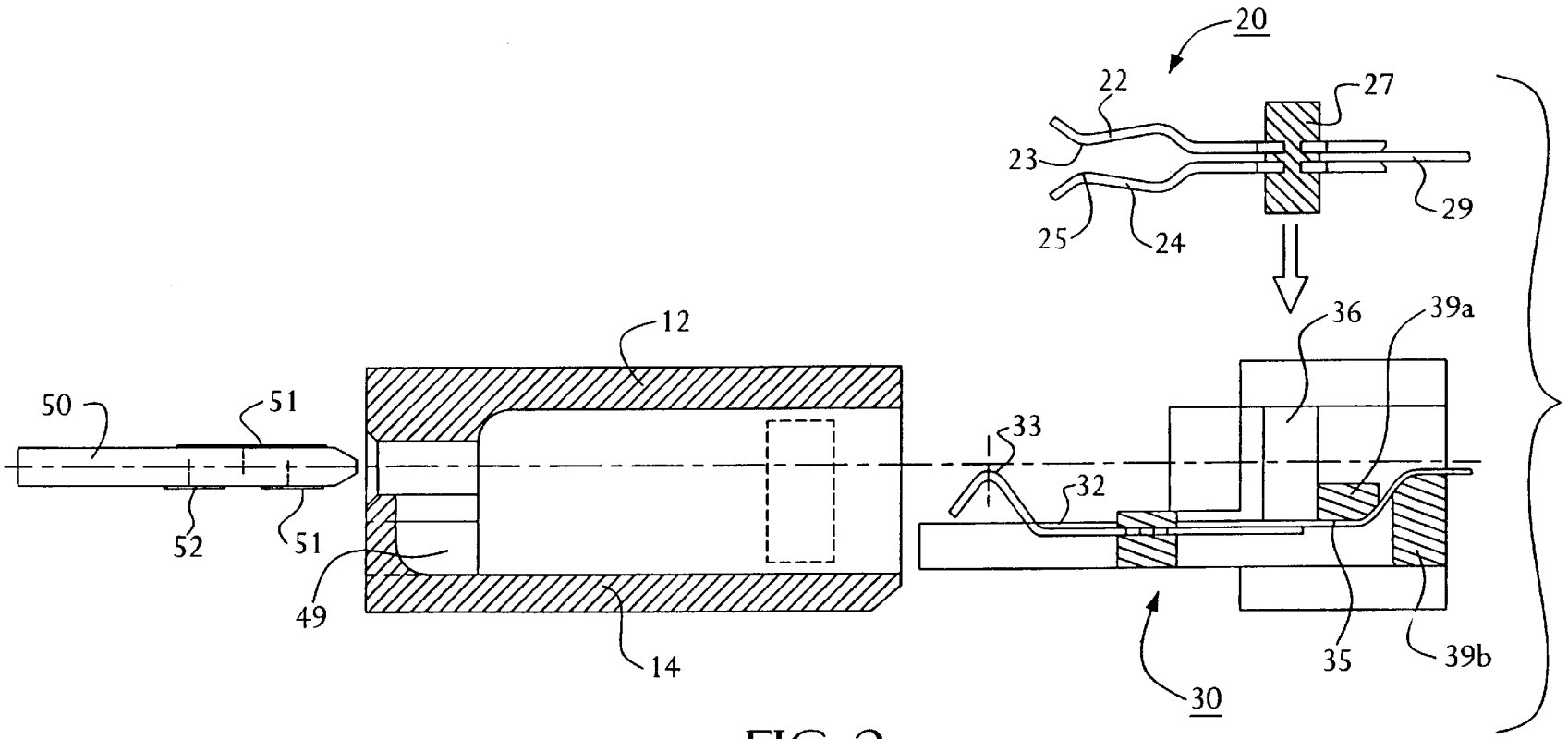
FIG. 2 is an exploded view of the connector of FIG. 1.

FIG. 1 is a cross-sectional view of an exemplary connector 10 in accordance with the present invention, and FIG. 2 is an exploded view of the connector of FIG. 1. The connector 10 comprises a first contact assembly 20, a second contact assembly 30, and a housing 11. The housing 11 is preferably a one piece molded plastic housing having first and second housing surfaces 12 and 14. The spaced apart housing surfaces 12 and 14 are joined by side walls to create an open area therebetween. One end of housing 11 has an edge connector receiving aperture 16 in communication with the open center area.

The internal components of the connector 10 consist of a first contact assembly 20 and a second contact assembly 30. The first contact assembly 20 is preferably a power contact assembly and comprises at least one pair of flexible contacts 22 and 24 having contact areas 23 and 25, respectively. The second assembly 30 is preferably an auxiliary contact assembly and comprises a flexible contact 32 having contact area 33. The first assembly 20 and the second assembly 30 are secured together then are pushed into the open interior of the housing, and are thereby trapped by the housing surfaces 12 and 14. It should be noted that while FIG. 1 shows one assembly 20 and one assembly 30, a plurality of assemblies 20, 30 can be arranged in parallel with each other in a row to provide a plurality of contacts within the connector 10, as described below.

First assembly 20 preferably has two flexible substrates 29 extending from a rail 27. Each substrate 29 can carry one, and typically a plurality of, the electrical conductors 22, 24 having contact areas 23, 25 towards an end of the flexible contact. The contact areas 23, 25 face the opposing substrate 29 and are positioned to connect with electrically conductive pads 51 on a substrate 50 of a printed circuit board (PCB) when the edge connector portion of the PCB is fully inserted into connector 10 through aperture 16. It should be noted that a PCB carries an array of circuit paths terminating at an edge connector portion in a row of electrically conductive pads 51. A similar row of pads is located on the underside of the PCB with the two rows typically being superimposed as a mirror image of one another. The edge connector portion containing the electrically conductive pads 51 is inserted into the edge connector receiving aperture 16 of the housing, with each electrically conductive pad 51 contacting a different contact in the connector. As used herein, "pads" shall be construed to include exposed conductors to which electrical connection is desired.

The contacts 22, 24 extend into a cavity of the housing so that the contact areas 23, 25 of the contacts align with the pads 51 of the PCB when the edge connector portion of the PCB is inserted into the connector through the edge connector receiving aperture 16 of the housing. The insert molding process which preferably forms first assembly 20 ensures that flexible contacts 22, 24 are spaced apart from each other by the plastic injected into the mold. The contact areas 23, 25 of contacts 22, 24 face one another, and are biased towards one another. The flexible contacts 22, 24 resiliently bias the contact areas 23, 25 into engagement with pads 51 of a PCB to which the connector is attached.

Figure 3A:
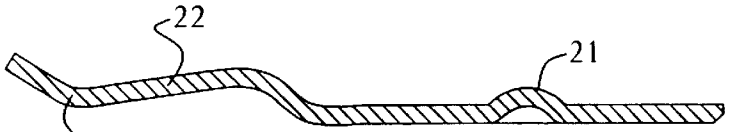
FIG. 3A is a detailed cross-sectional view of an exemplary first contact in accordance with the present invention.
Figure 3B:
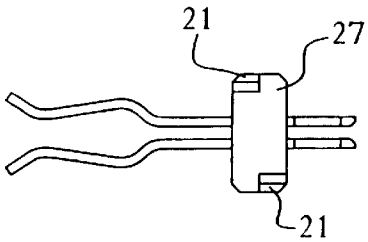
FIG. 3B is a cross-sectional view of a pair of exemplary first contacts in a first exemplary assembly in accordance with the present invention.

FIG. 3A is a detailed cross-sectional view of substrate 29 showing an exemplary first contact used in the first contact assembly 20 in accordance with the present invention. Preferably, the first contact is a power contact. As described above, the contact 22 has a contact area 23. Moreover, the contact 22 has a bump 21 extending from a window 26 that is used in securing the contact 22 to a mounting portion or rail 27 of the assembly 20, as shown in FIG. 3B. Preferably, the assembly 20 is a power contact assembly which holds the power contacts and power cable. As shown in FIG. 3B, the same contact design (of FIG. 3A) is used for the hot contact and the ground contact (contacts 22 and 24). Preferably, the two contacts are insert molded into the rail 27. This minimizes the separation of the contacts from each other and provides rigidity to assembly 20 for ensuring suitable contact normal force, while also providing the desired separation of the contact tails for attachment of a flex cable. Although a bump 21 is shown, it is contemplated that other attachment means can be used to secure the contact 22 to the assembly 20. Assembly 20 includes latch structure 21 for securing to second assembly 30. The latch can reside at both ends of assembly 20 in order to allow insertion of assembly 20 into assembly 30 in either orientation (e.g., with contacts 22 on top or with contacts 24 on top).

Figure 3C:
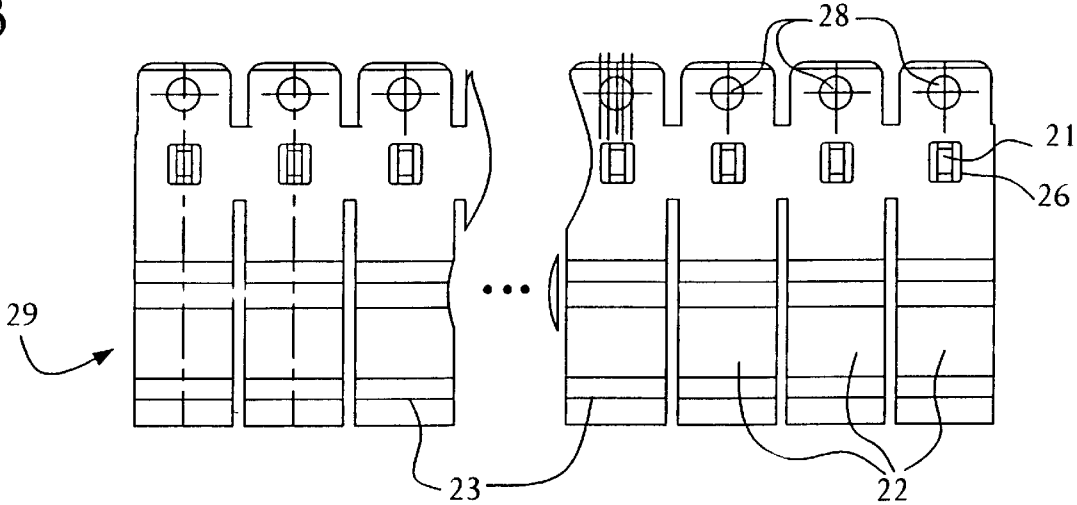
FIG. 3C is a top view of an exemplary structure of a plurality of first contacts accordance with the present invention.

FIG. 3C is a top view of an exemplary structure of substrate 29 with a plurality of first contacts that are formed in parallel with one another. It should be understood that the present invention can have any suitable pitch between contacts (to match the pitch between pads on the PCB), as tolerances allow. The contact assembly 20 is designed so that it can be accessed from both the top and bottom surfaces. This allows a cable assembler to have free access during soldering and other assembly processes. Furthermore, at the end opposite the contact area, the contacts 22, 24 preferably have alignment holes 28 in their tails to provide for carrier alignment during stamping, plating, and molding. The circular openings or holes 28 also provide locations for inspection of the solder joint. Each hole 28 can also be used to engage corresponding openings in the end portion of a flexible cable 29 to locate the flexible cable 29 relative to the first contacts. Preferably, the first contacts and the flexible cables are sufficiently compliant to allow for the preferred engagement of the contact areas 23, 25 and the pads 51 of the PCB 50 despite any possible misalignment as a result of the manufacturing process.

Preferably, the contacts 22, 24 are stamped and formed to have a preloaded spring rate that provides the desired normal force at the respective contact surface with the PCB when the PCB is fully engaged in the connector. The contacts 22, 24 preferably comprise beryllium-copper (Be-Cu). In accordance with the invention, the materials selected, the geometric configuration of the contacts 22, 24, and the use of overmolded rail 27 ensures that a sufficient normal force is generated at the respective contact areas 23, 25 to ensure electrical reliability of the interconnections.

Figure 3D:
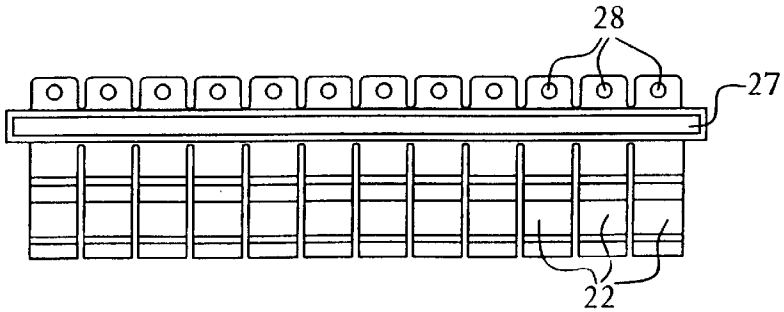
FIG. 3D is a top view of the structure of FIG. 3C mounted in a rail of the first exemplary assembly.
Figure 3E:
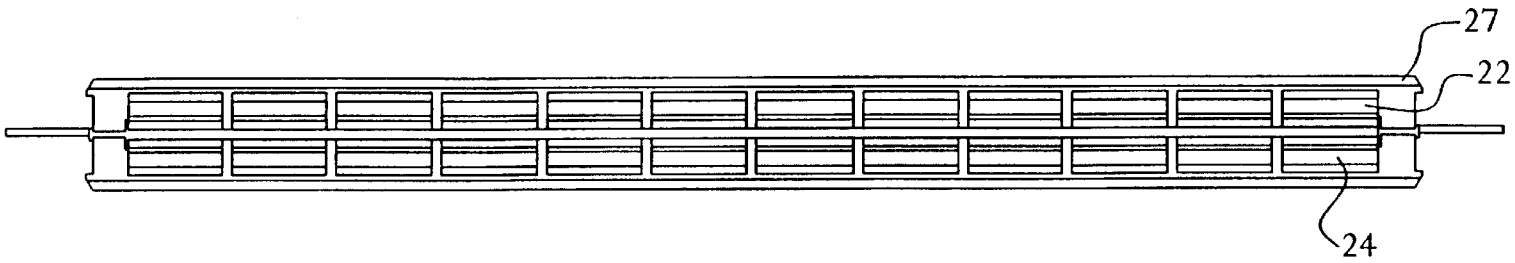
FIG. 3E is a front view of the structure of FIG. 3D.
Figure 3F:
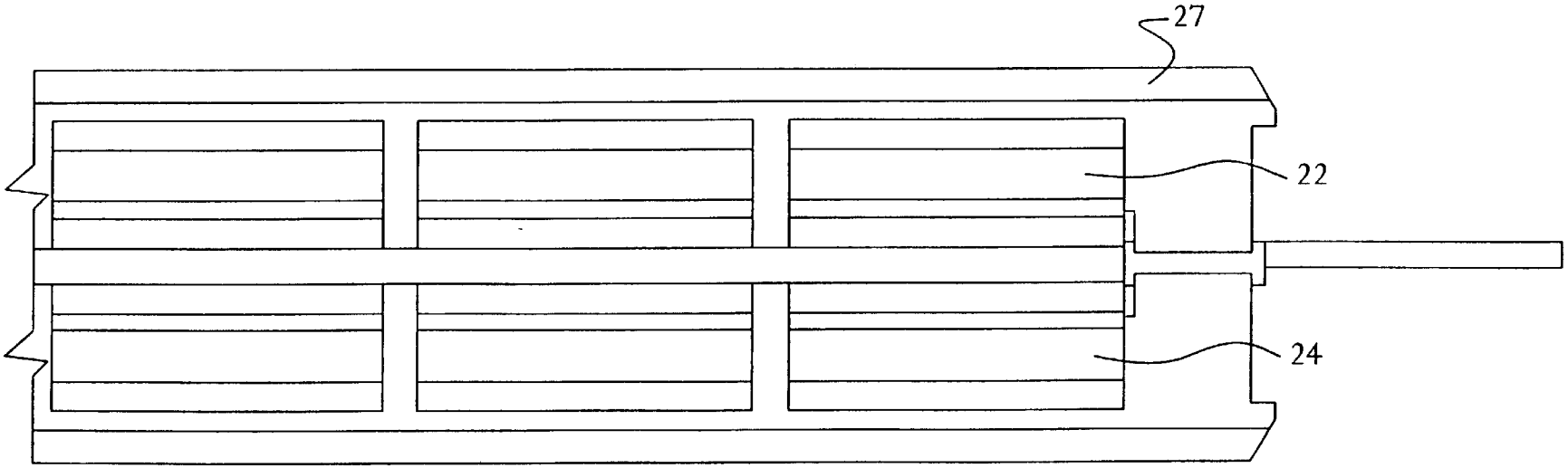
FIG. 3F is a detailed view of a portion of the structure of FIG. 3E.

FIG. 3D is a top view of the substrate 29 shown in FIG. 3C after mounting to a rail 27 of the assembly 20. As described above, the contacts 22, 24 are insert molded into the rail 27, which is preferably plastic. To provide strain relief, a positive lock, and mold flow redirection during formation of rail 27, contacts 22, 24 have windows 26 and raised sections or bumps 21. During the injection of material into the mold (preferably coming from the short side of the plastic rail), the bumps 21 disrupt the flow and force the material through the windows 26 and in-between the two rows of contacts. After molding, a flex cable 29 is then slid in from the rear end (i.e., the end opposite the interface tine which is the end having the contact areas) and soldered to the contacts 22, 24. In this embodiment, rows of contacts 22, 24 extend from a common rail 27. FIG. 3E is a front view of the structure of FIG. 3D, and FIG. 3F is a more detailed view of the structure of FIG. 3E.

Figure 3G:
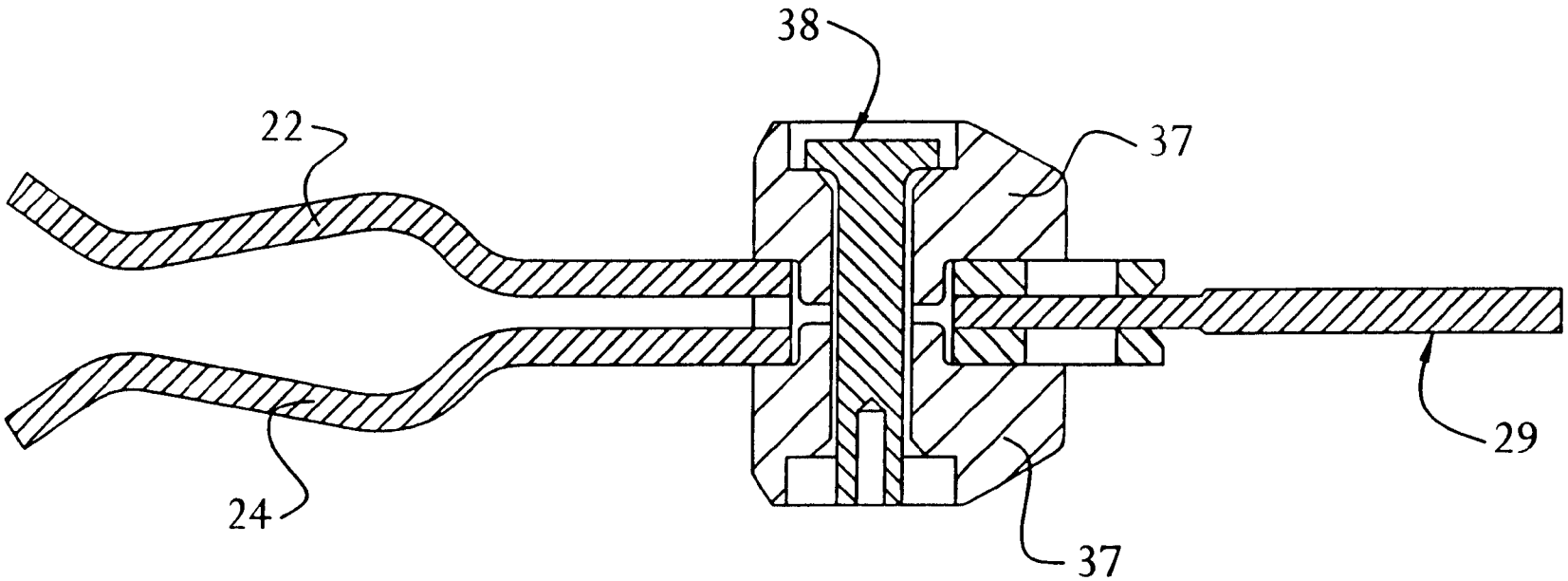
FIG. 3G is a cross-sectional view of a pair of exemplary first contacts in a second exemplary assembly in accordance with the present invention.
Figure 3H:
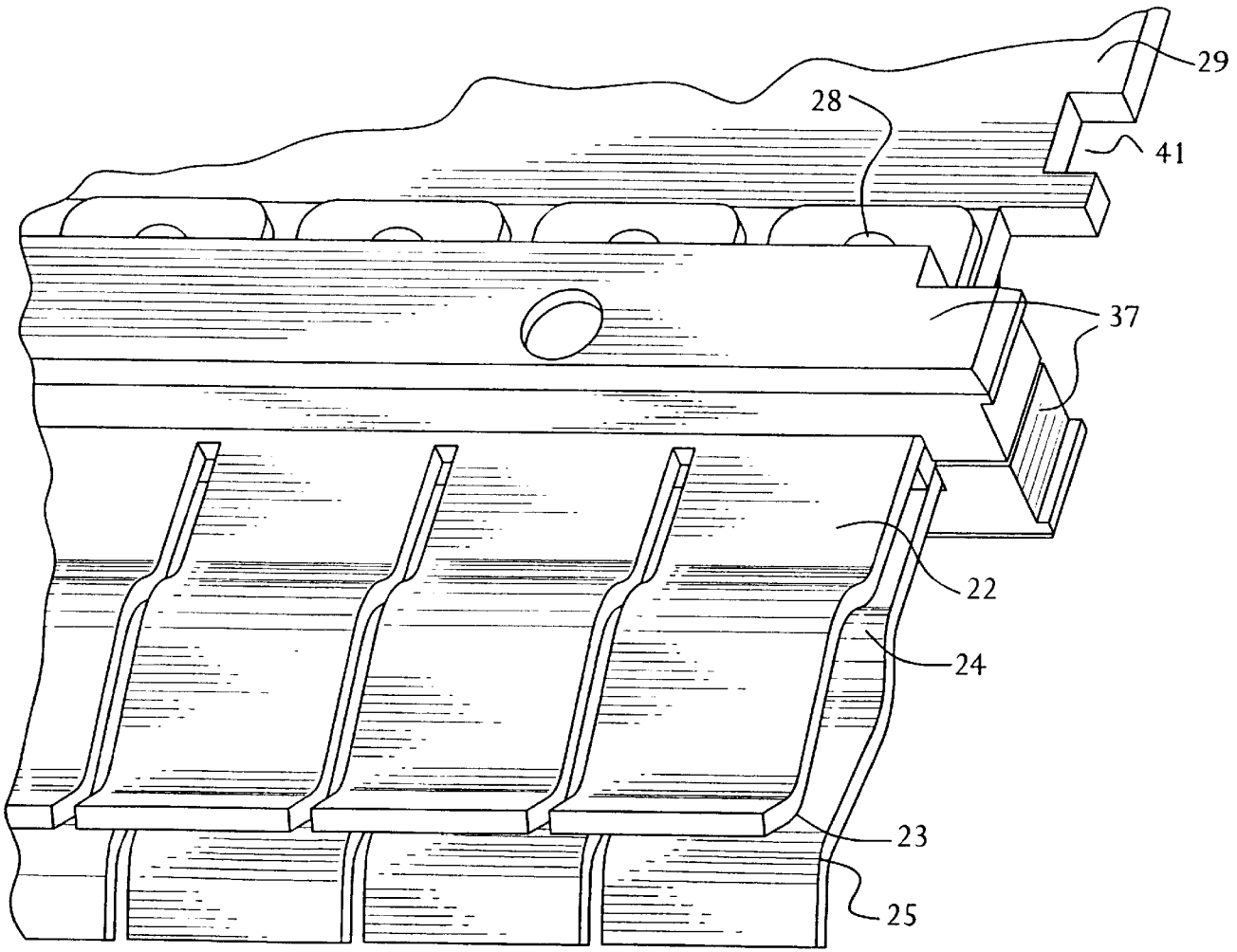
FIG. 3H is a perspective view of the exemplary first contacts in a second exemplary assembly in accordance with the present invention.
Figure 3I:
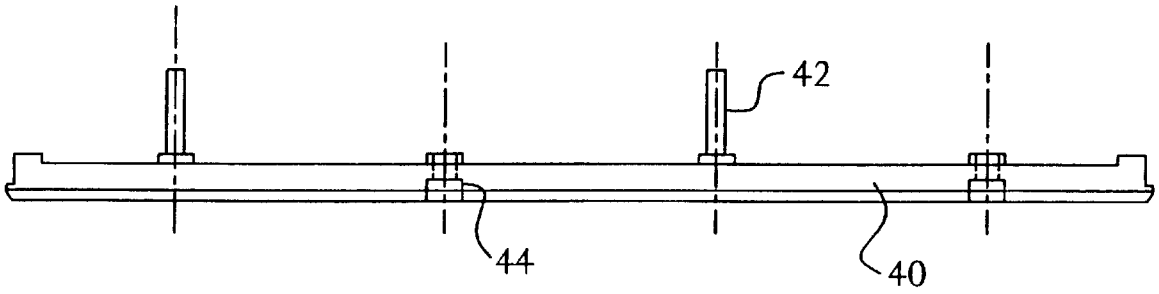
FIG. 3I is a side view of an exemplary rail for use with the present invention.
Figure 3J:
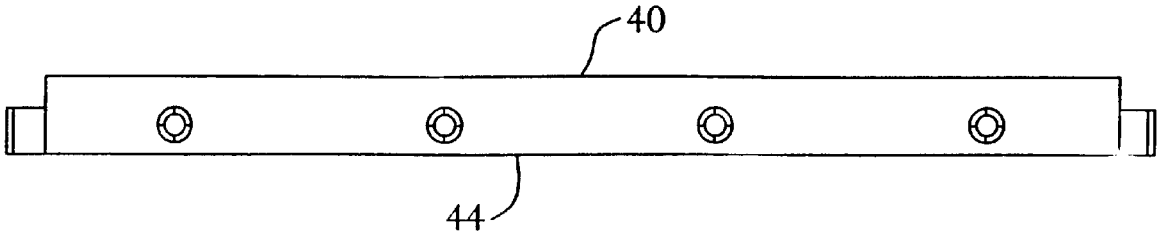
FIG. 3J is a top view of the rail of FIG. 3I.

A side view of an alternate power contact assembly is shown in FIG. 3G, and shown in perspective in FIG. 3H. In this embodiment, the two substrates 29 having the contacts 22, 24 are soldered to opposite sides of the flex cable 29 initially. The flex cable preferably comprises 4 ounce copper and serves to separate contacts 22, 24 once soldered thereto. The ends of the flexible cable 29 which are remote from the connector described may be terminated in any conventional manner or may be terminated in a similar connector to that described. It will be appreciated that the engagement of the contacts 22, 24 with their attached flexible cables 29 ensures that the free ends of the contacts and the associated end portions of the flexible cables do not interfere with the insertion of an edge connector portion of a PCB to the connector. Two pre-molded rails 37, preferably plastic, which are the same part for top and bottom, are used to trap the flex cable 29 between contacts 22, 24. The assembly is held together either by rivets 38 as seen in FIG. 3G or in production by making molded rails 40 which have protruding posts 42 as seen in FIGS. 3I and 3J. The posts 42 pass through through holes 44 in the rails 40 similar to the rivets 38. A reform process (such as heat stake) deforms the tip of posts 42, preventing posts 42 from exiting through holes 44 and holding the assembly together. The posts 42 preferably are staggered with through holes 44, as shown in FIGS. 3I and 3J, so that when rails 40 are put together, the same part top and bottom can be used. The advantage of this embodiment is that it does not use insert molding, provides lower inductance by allowing cable to be moved all the way forward in the contact, and can provide for easier right angle connector assembly.

Figure 4A:
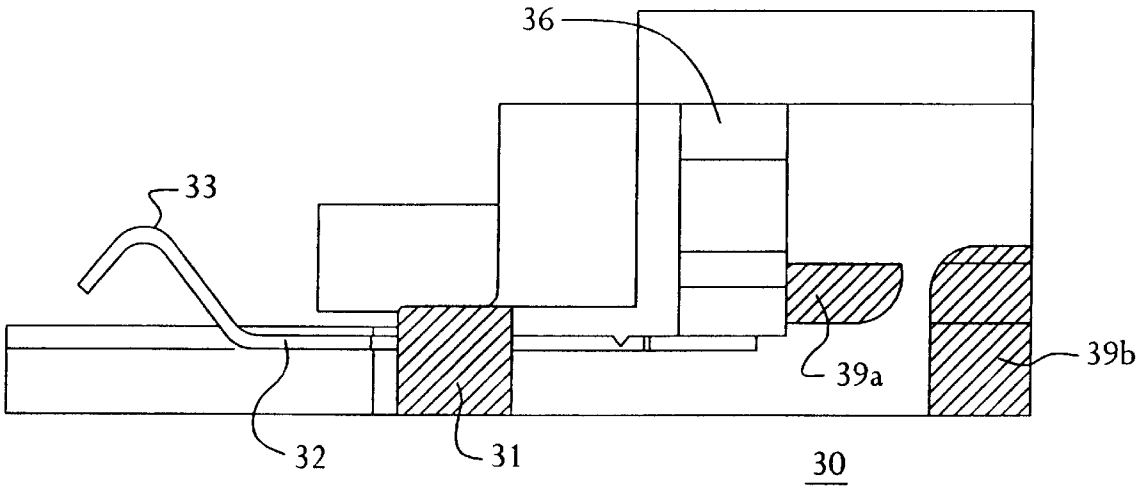
FIG. 4A is a cross-sectional view of an exemplary second contact assembly in accordance with the present invention.
Figure 4B:
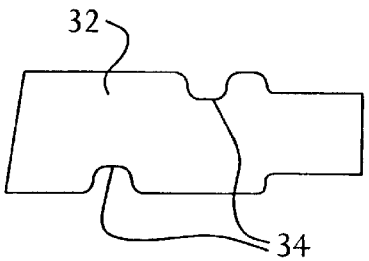
FIG. 4B is a side view of a contact retention region in an exemplary second contact in accordance with the present invention.

FIG. 4A is a cross-sectional view of an exemplary second contact 32 mounted in an assembly 30 in accordance with the present invention. The assembly 30 is preferably an auxiliary contact subassembly in which the contacts 32 are insert molded into the housing 31. Each contact 32 has notches or undercuts 34, as shown in FIG. 4B. FIG. 4B shows the portion of the contact 32 that is hidden by the housing 31 in FIG. 4A. The undercuts 34 fill with plastic and trap the contact 32 in the housing 31 during the insert molding step for rigidity.

Figure 4C:
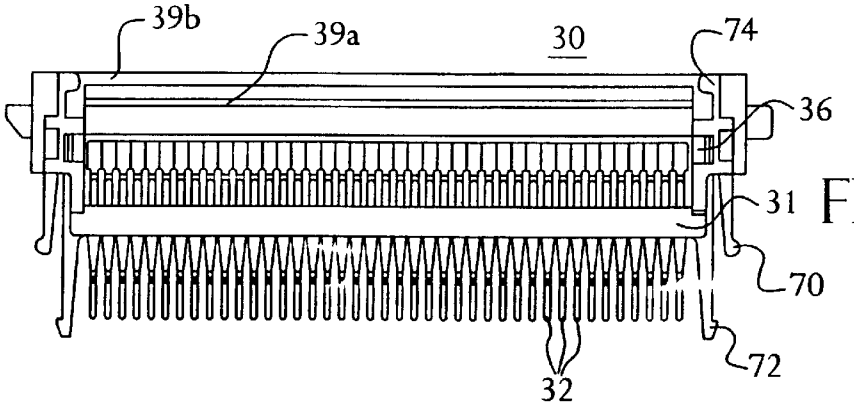
FIG. 4C is a top view of an exemplary structure of a plurality of second contacts in accordance with the present invention.
Figure 4D:
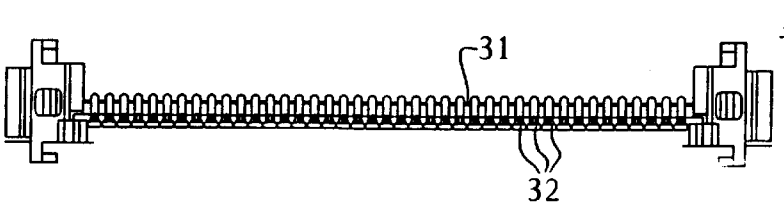
FIG. 4D is a front view of the structure of FIG. 4C.

A plurality of the contacts 32 can be placed in parallel to form a multiple contact assembly. FIG. 4C is a top view of an exemplary structure of a plurality of second contacts in an assembly in accordance with the present invention, and FIG. 4D is a front view of the structure of FIG. 4C.

The contacts 32 are preferably used to contact additional voltage and signal connections to the PCB, via a flexible cable 35. The contacts 32 have respective contact areas 33 that are positioned to connect with a secondary set of electrically conductive pads 52 of a PCB when the connector 10 is attached to the edge connector portion of the PCB. The secondary pads 52 are preferably positioned behind the pads 51.

The contacts 32 can be used for both I/O and cache power connection between the PCB substrate 50 and the flex cable 35, as shown in FIG. 1. As described above, the contacts 32 are insert molded into the housing 31. The insert molding process used to form housing 31 is designed without the need for side action or camming. The assembly 30 is open in the center to provide good visual access to the contacts 32 during the soldering operation that connects the flex cable 35 to contacts 32. To provide stress relief for the cable 35, the cable 35 travels a serpentine path around two cross beams 39*a*, 39*b*. As shown in a perspective view of the assembly 30 in FIG. 4E, the cable 35 is inserted through a slot 68 formed by cross beams 39*a*, 39*b*. Cross beams 39*a*, 39*b* also provide stability to the assembly and serve to retain the first assembly 20 during assembly of connector 10.

Figure 4E:
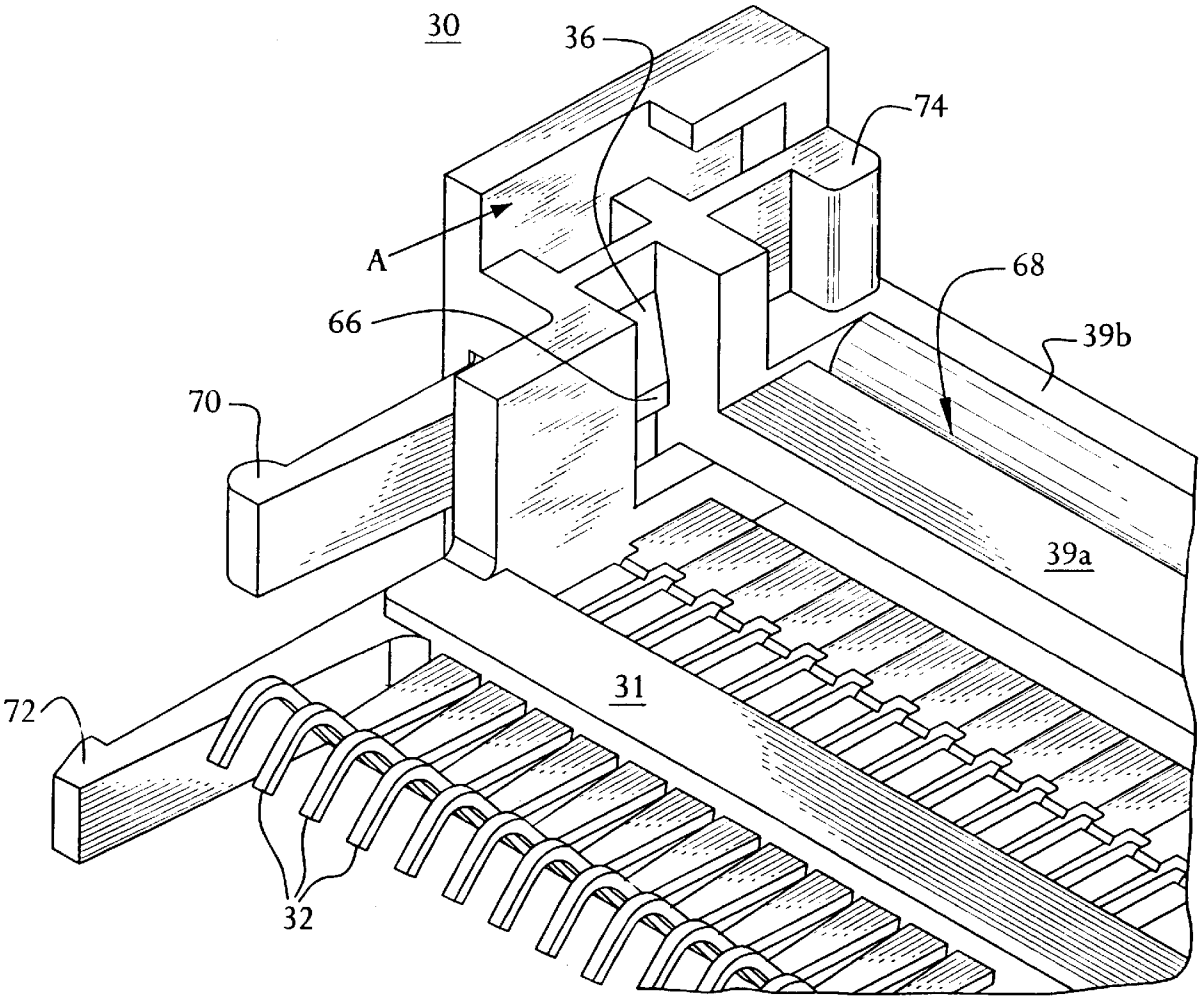
FIG. 4E is a perspective view of the assembly of FIG. 4A.

The assembly 30 also has a slot 36 into which the first assembly 20 is inserted. A tab 21 of the assembly 20 is inserted in slot 36 in the assembly 30, as shown in FIG. 4E. A raised area 66 along a surface of the slot 36 retains the tab 21 within slot 36 after tab 21 passes by raised area 36 in order to secure the assembly 20 to the assembly 30.

The assembly 30 is secured within the outer housing 11. The housing 11 engages the assembly 30 in the direction of arrow A as shown in FIG. 4E. A latch 72 on the assembly 30 is used to engage the housing 11. The latch 72 is inserted into an aperture 64 in the housing 11 (the front of aperture 64 is shown in FIG. 5E). Another latch 70 on the assembly 30 is used to engage a feature on the PCB that is inserted into the housing 11.

A projection 74 on the assembly 30 engages a notch 41 in the flex cable 29. To provide stress relief for the cable 29 attached to the first assembly 20, two side flanges projections 74 are provided, into which the cable 29 is slid, thus keeping it from being pulled out. Once assembly 20 snaps into assembly 30, the cable 29 traps the auxiliary cable 35, which minimizes inductance by placing cable 29 up against the auxiliary cable 35. The contacts, mating tines, and mounting ears are provided so that the mating forces are all collocated, and therefore are not affected by the assembly tolerances.

Figure 4F:
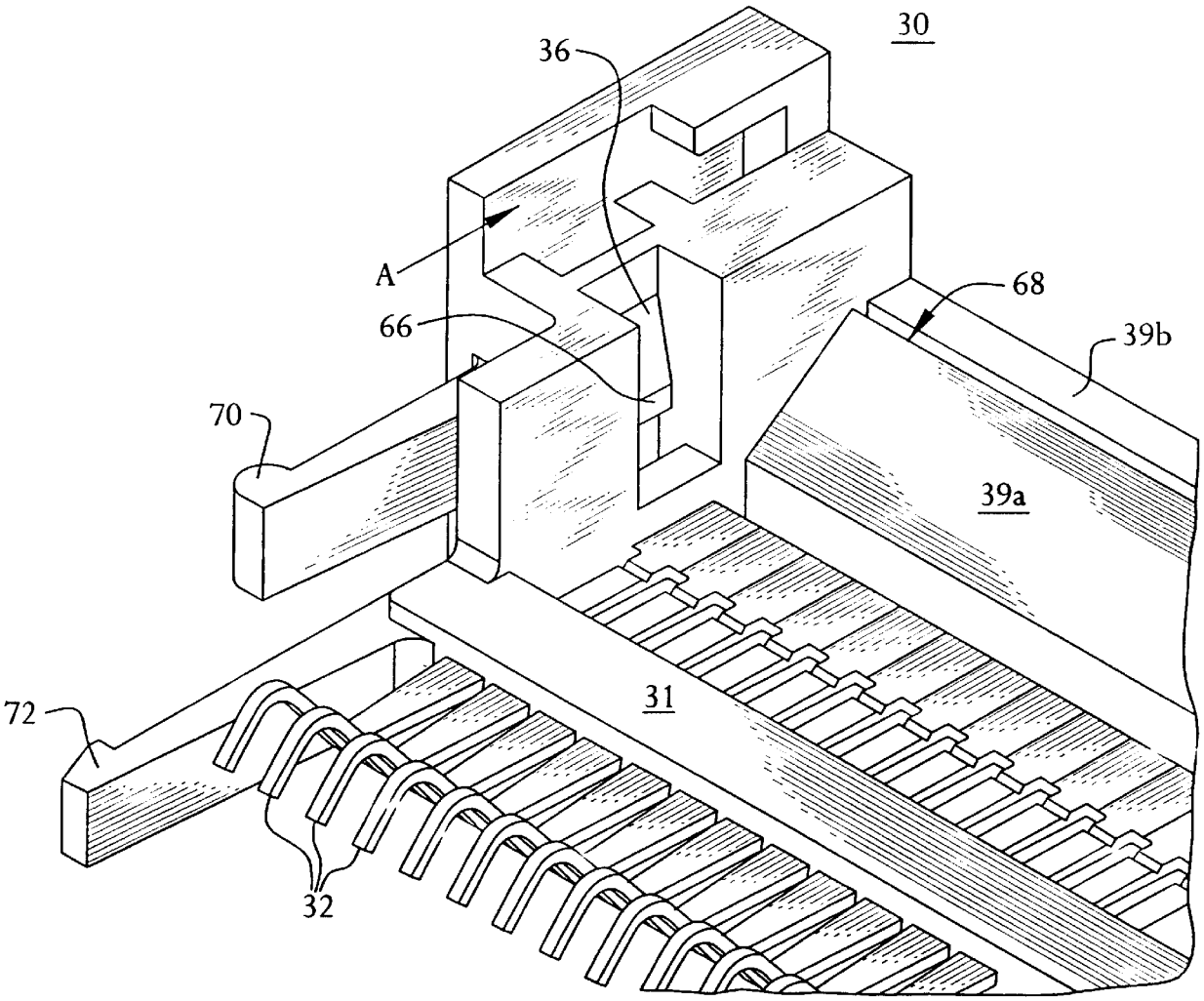
FIG. 4F is a perspective view of an alternate assembly of FIG. 4A.

FIG. 4F is a perspective view of an alternate assembly of FIG. 4A. The assembly in FIG. 4F is similar to the assembly shown in FIG. 4E except it does not have a projection 74 for engaging a notch in the flex cable 29. This embodiment would be preferably used if the flex cable 29 does not have an associated notch.

Figure 5A:
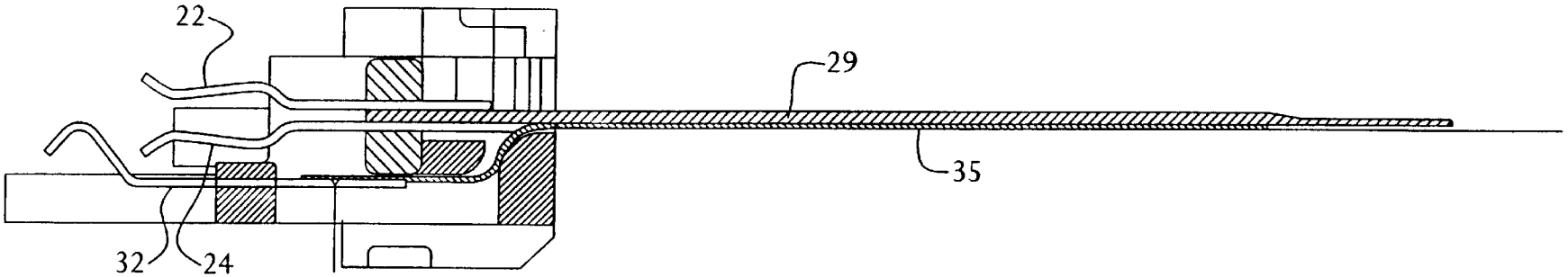
FIG. 5A is a cross-sectional view of the connector of FIG. 1 connected to a flex cable.
Figure 5B:
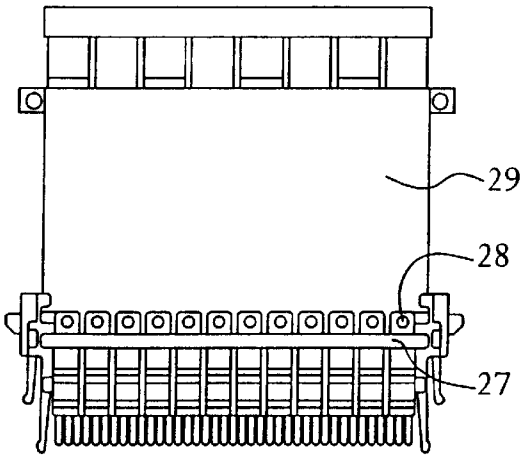
FIG. 5B is a top view of a structure comprising the connector of FIG. 5A.
Figure 5C:
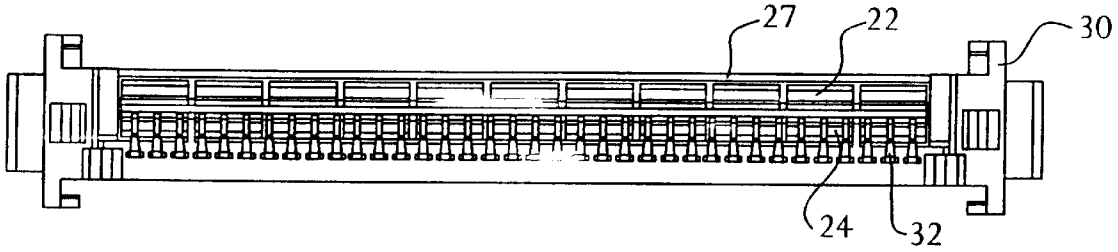
FIG. 5C is a front view of the structure of FIG. 5B.
Figure 5D:
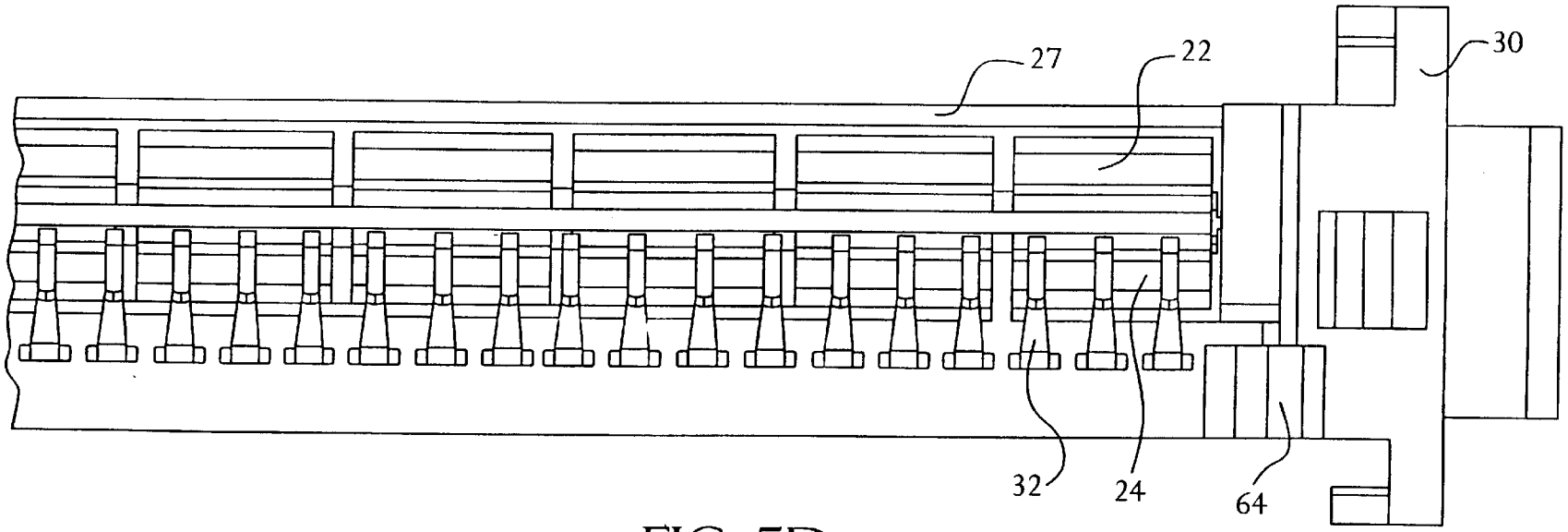
FIG. 5D is a detailed view of a portion of the structure of FIG. 5C.

FIG. 5A is a cross-sectional view of the connector of FIG. 1 connected to flex cables 29 and 35, without the housing 11. In other words, the two assemblies 20, 30 have been joined together but not yet inserted into housing 11. Once assembly 20 snaps into assembly 30, the plurality of connectors 22, 24, 32 are formed in parallel to make up a connector having a plurality of contacts. FIG. 5B is a top view of such a structure comprising a plurality of the connectors of FIG. 5A. FIG. 5C is a front view of the structure of FIG. 5B, and FIG. 5D is a more detailed view of a portion of FIG. 5C. The modularity of the two assemblies 20, 30 within the connector itself provides easy installation of the cables to the contacts, and inspection thereof.

Figure 5F:
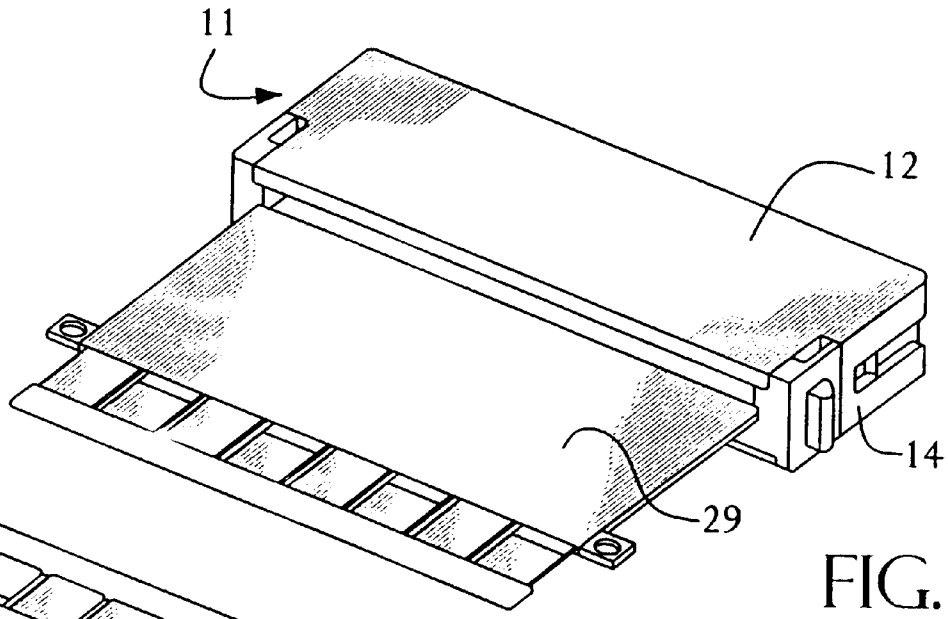
FIG. 5F is another perspective view of the structure of FIG. 5B enclosed in a contact housing.
Figure 5E:
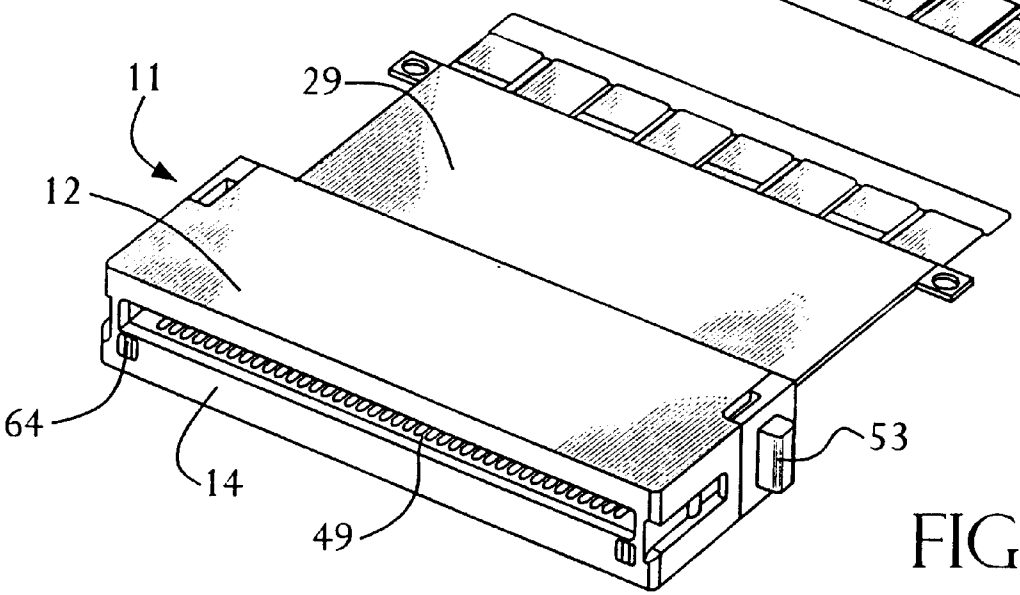
FIG. 5E is a perspective view of the structure of FIG. 5B enclosed in a contact housing.

FIG. 5E is a perspective view of the front of the structure of FIG. 5B enclosed in outer housing 11. FIG. 5F is a perspective view of the rear of the structure of FIG. 5B enclosed in a contact housing. The inner assembly, comprising assemblies 20 and 30, is pushed into the outer housing 11 where apertures (see FIG. 5E) retain two lower side tines 72 (see FIG. 4C). The outer housing 11 provides for aligmnent of the PCB substrate 50 to the contacts 22, 24, 32 through the front receiving aperture 16. Internally, the outer housing 11 has spacers 49 to separate and align the auxiliary contacts 32 to the substrate pads 52. The tops of the spacers 49 also provide a support surface for the substrate 50 while inserted into housing 11.

Figure 6A:
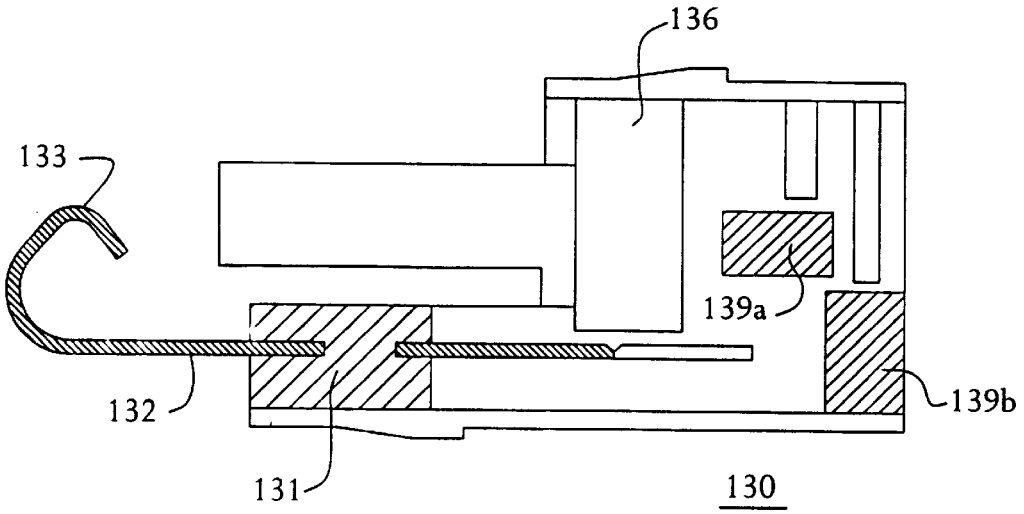
FIG. 6A is a cross-sectional view of another exemplary second contact assembly in accordance with the present invention.
Figure 6B:
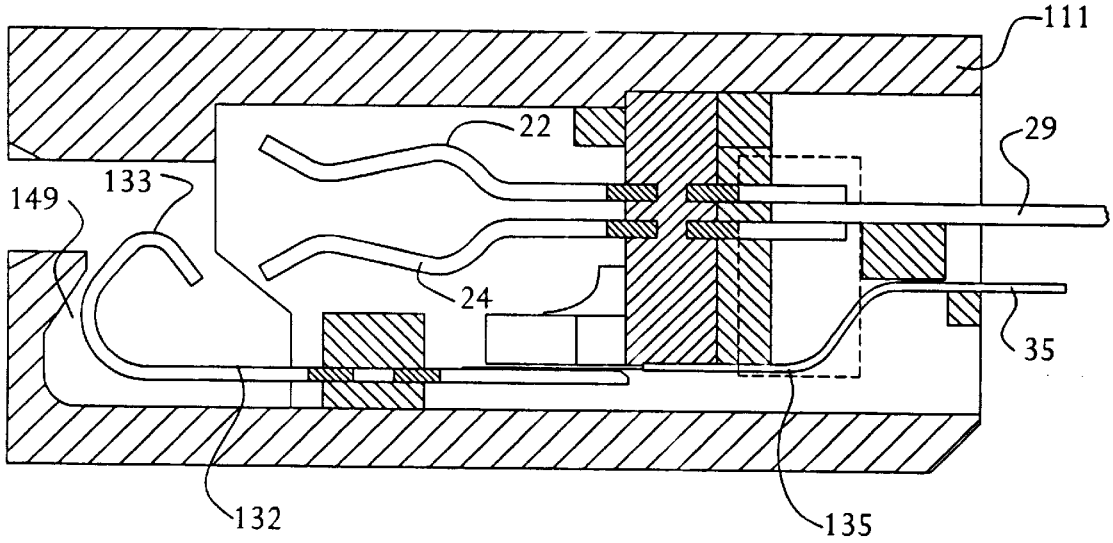
FIG. 6B is a cross-sectional view of the second contact of FIG. 6A incorporated into a connector in accordance with the present invention.

FIG. 6A is a cross-sectional view of another exemplary second contact 132 in accordance with the present invention. The contact 132 has a contact area 133 which performs in a similar manner to contact area 33 described above. The contact areas 133 are positioned to connect with a secondary set of electrically conductive pads 52 of a PCB when the connector 10 is attached to the edge connector portion of the PCB. The end of the contact 132 away from the flex cable 35 is hook or U shaped.

The contacts 132 can be used for both I/O and cache power connection between the PCB substrate 50 and the flex cable 35, as shown in FIG. 1. As with assembly 30, the contacts 132 are insert molded into the housing 131. Further, the insert molding process used to form housing 131 is also designed without the need for side action or camming. The assembly 130 is open in the center to provide good visual access to the contacts 132 during the soldering operation that connects the flex cable 35 to contacts 132. To provide stress relief for the cable 35, the cable 35 travels a serpentine path around two cross beams 139*a*, 139*b*. The cable 35 is inserted through a slot formed by cross beams 139*a*, 139*b*. Cross beams 139*a*, 139*b* also provide stability to the assembly and serve to retain the first assembly 20 during assembly of connector 10.

The assembly 130 also has a slot 136 into which the first assembly 20 is inserted. A tab 21 of the assembly 20 is inserted in slot 136 in the assembly 30. The tab 21 is engaged by a projection (similar to projection 66 in FIG. 4E) to secure the assembly 20 to the assembly 130. The assembly 130 can be secured within the outer housing 11 in a manner similar to that described above with respect to FIG. 4E.

Figure 7A:
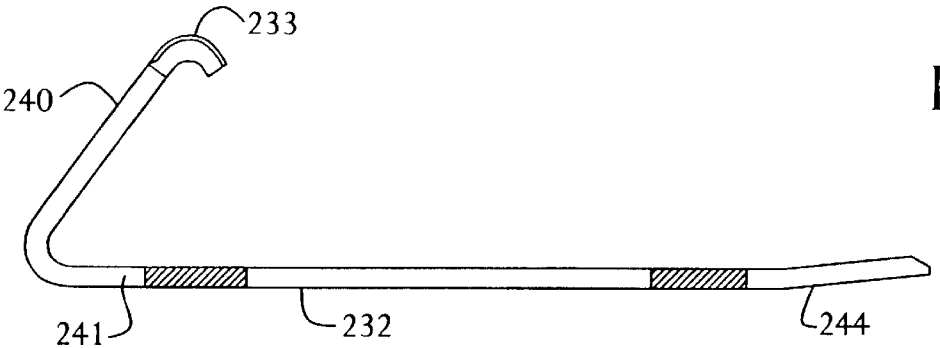
FIG. 7A is a cross-sectional view of another exemplary second contact in accordance with the present invention.
Figure 7B:
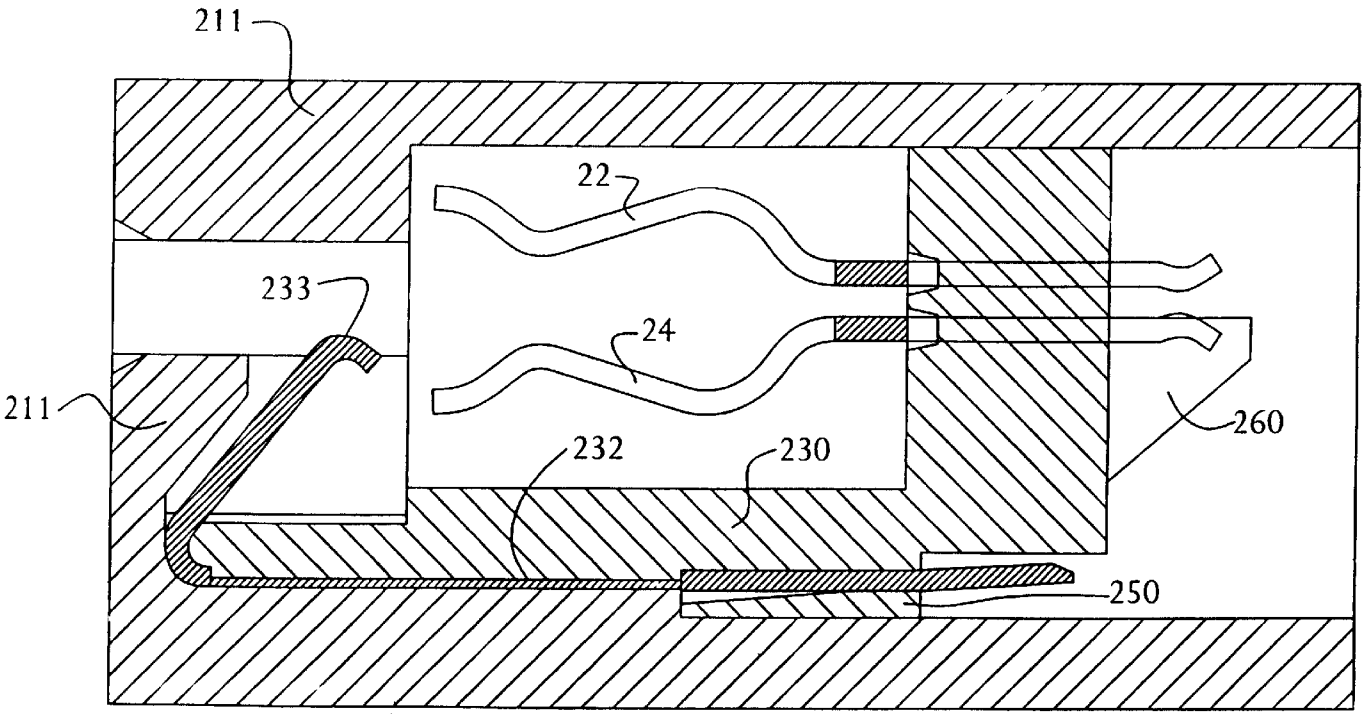
FIG. 7B is a cross-sectional view of the second contact of FIG. 7A incorporated into a connector in accordance with the present invention.

FIG. 7A is a cross-sectional view of another exemplary auxiliary or second contact 232 in accordance with the present invention. The contact 232 has a contact area 233 which performs in a similar manner to contact area 33 described above. The contact 232 is preferably hook or V shaped, with one leg 240 being at an acute angle, preferably about 45 degrees, with respect to the other leg 241. Preferably, the tail portion 244 of the contact 232 is biased (bent) to improve the connection with a flex cable (such as flex cable 35). The bent portion and a surface of housing 230 form an area therebetween. The contact 232 is mounted in an assembly 230 which can then be used in a connector comprising a first assembly 20 and a housing 211 as shown in FIG. 7B that is similar to that described above with respect to FIG. 1. The flex cable is trapped between the bent portion and housing 230.

In FIG. 7B, the contact 232 resides between the housing 230 of the second assembly and the outer housing 211. Moreover, the contact tail 244 is disposed through a slot formed between fins 250 extending from the inner housing 230. The contact tail 244 is preferably soldered to the flex cable 35 (not shown in FIG. 7B) as the flex cable rests on rails 250. The inner housing 230 with contacts 232 and cable are then pushed into the outer housing 211, thus trapping the contacts 232 between the two. Another series of fins 260 are preferably added to the inner housing 230 to provide support to the flex cable 29 secured to contacts 22, 24. As seen in FIG. 7B, contact 24 extends between and above adjacent rails 260. Preferably, both the inner housing 230 and the outer housing 211 comprise plastic.

Figure 8A:
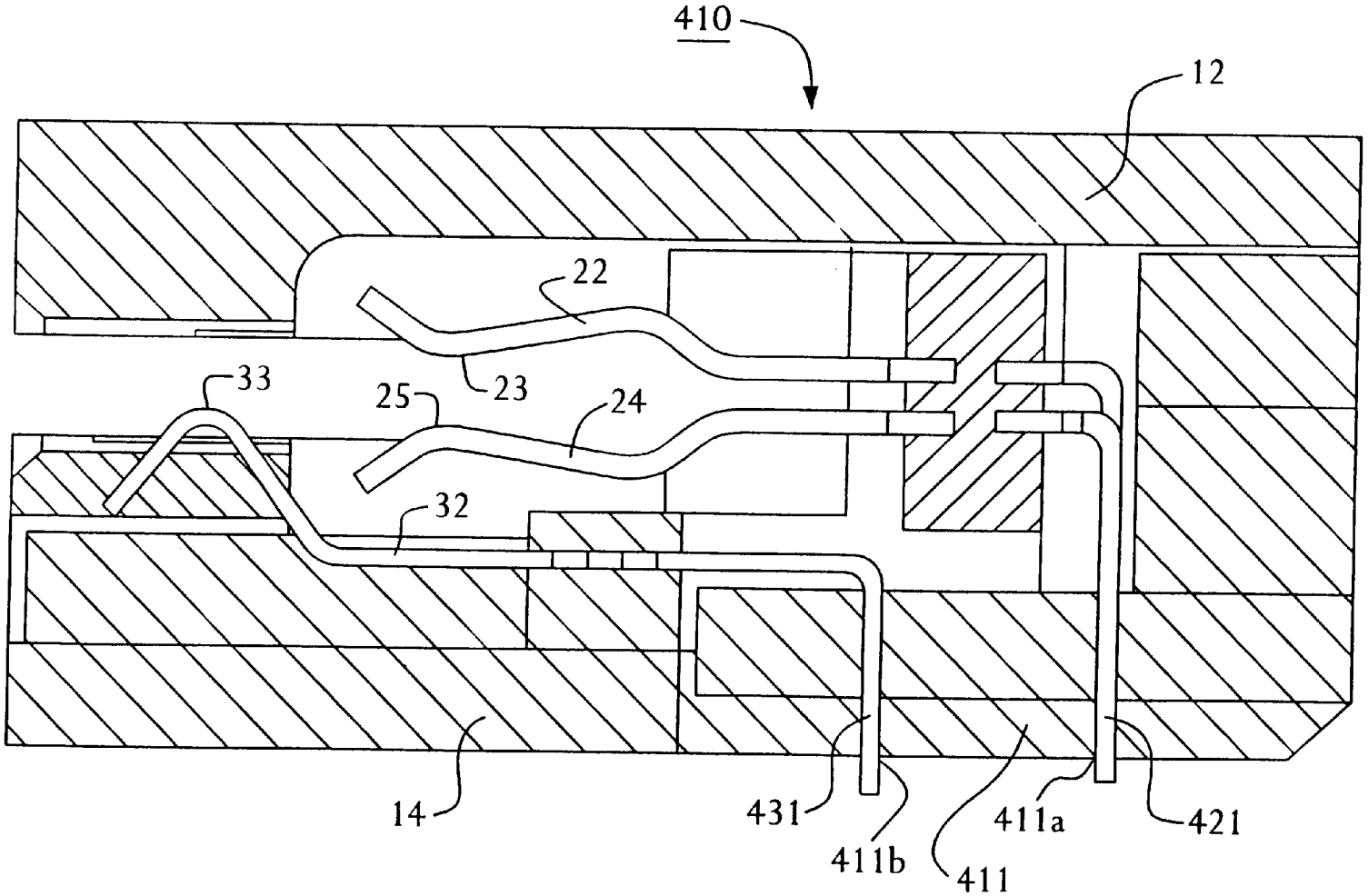
FIG. 8A is a cross-sectional view of an exemplary right angle PCB connector in accordance with the present invention.
Figure 8B:
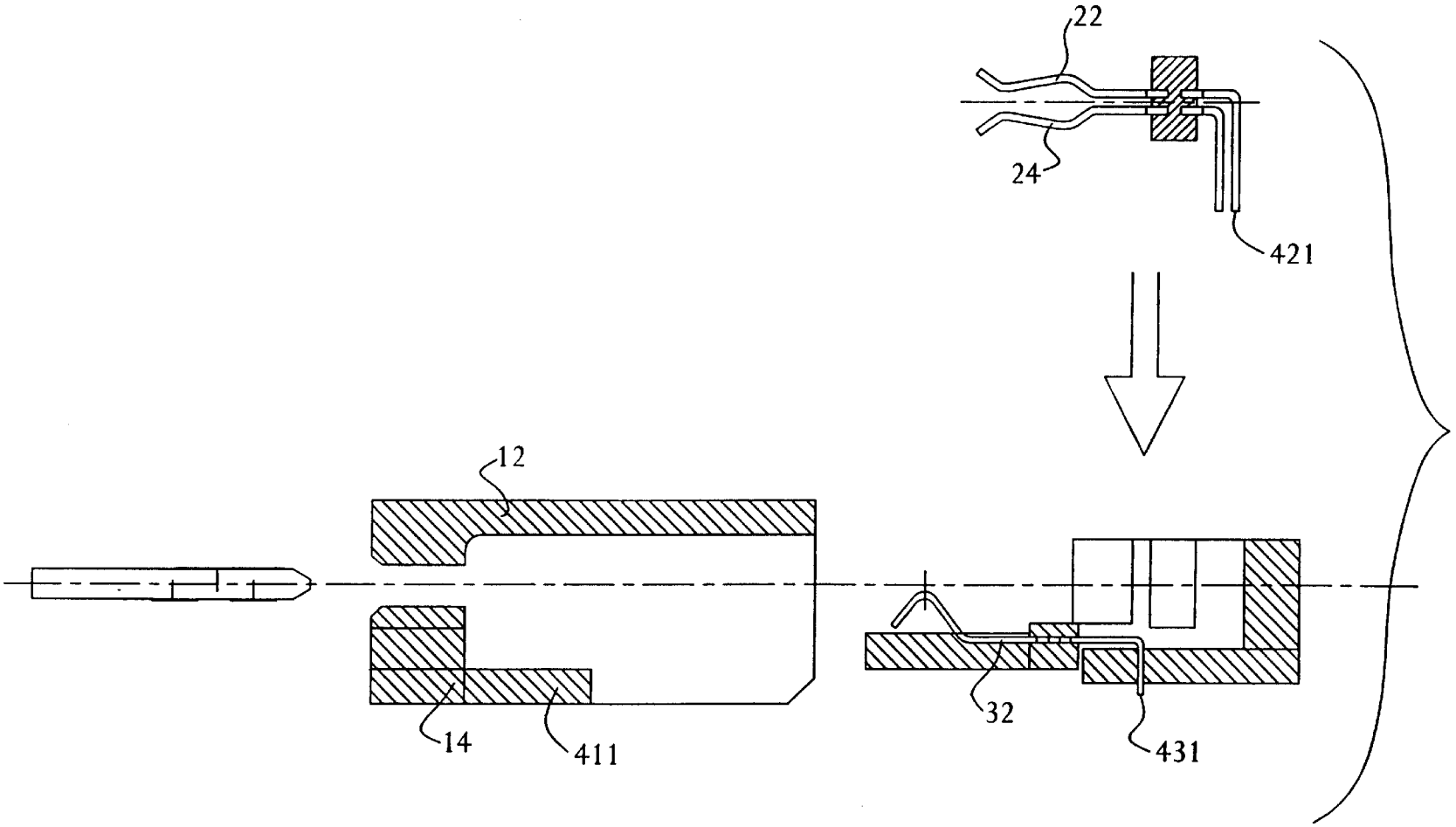
FIG. 8B is an exploded view of the connector of FIG. 8A.

FIG. 8A is a cross-sectional view of an exemplary right angle connector in accordance with the present invention, and FIG. 8B is an exploded view of the connector of FIG. 8A. The connector is a right angle or direct PCB mount connector version of the connector of FIG. 1 (which secures in a larger housing (not shown) using blocks 53). The connector 410 is similar to the connector 10 described above with respect to FIG. 1, but the tail ends 421 of the contacts 22 and 24 extend approximately perpendicularly out of the housing instead of being generally parallel to the bottom surface of the housing as in FIG. 1. Similarly, the tail end 431 of the contact 32 extends approximately perpendicularly out of the housing instead of being generally parallel to the bottom surface of the housing as in FIG. 1. In this manner, the connector can be used as a right angle connector.

It should be noted that in FIG. 8A, the contacts 22 and 24 are shown as interleaved to enter a single row of through holes in the PCB, whereas in FIG. 8B the contacts 22 and 24 are shown as being able to enter rows arranged side-by-side. Although either arrangement can be used, it is preferable to have the contacts in a side-by-side arrangement in order to further reduce the inductance and resistance of the contacts. The side-by-side arrangement is preferably implemented as a "contact sandwich" as shown, for example, in FIGS. 3E and 3F. In this manner, the contacts 22 and 24 are formed separately and then assembled into the power contact module (assembly 20).

The contacts 421, 431 are connected to a direct mount PCB (not shown) by means of through holes 411*a*, 411*b* in the connector housing 411. The connector can be soldered to the PCB and/or rigidly attached with screws. To minimize the inductance between the power and ground contacts, as well as to allow for ease of bending after molding, the two contacts 22, 24 are interleaved. Like the flex cable connector of FIG. 1, the assembly containing the contacts 22, 24 is slid into the assembly containing the contact 32 and retained by a latch structure. The combined assembly is then slid into the outer housing 411 and also secured by a latch structure. The outer housing 411 preferably has a pocket at the bottom to provide clearance for the PCB and keep it inside the connector, thus having essentially the same outline envelope as the flex cable connector of FIG. 1.

It will be appreciated that while the embodiments of the present invention have been described utilizing a pair of flexible cables suitable for communication with contact pads of both faces of a PCB or with two parallel rows of pads on one face of a PCB, the invention is applicable for use with a flexible cable arrangement for communicating with a single row of contact pads of a PCB.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. A connector comprising:

a first contact assembly comprising a first flexible contact and an opposing second flexible contact, each flexible contact having a contact area towards one end of the flexible contact that is electrically connectable with associated electrically conductive pads on a circuit board;

a second contact assembly comprising a flexible contact having a contact area at one end thereof for electrically connecting with an associated electrically conductive pad on the circuit board; and an outer housing for accepting the first contact assembly and the second contact assembly, the housing having an aperture at one end to receive the circuit board containing the electrically conductive pads.

2. The connector according to claim 1, wherein each of the first and second flexible contacts comprises a flexible substrate carrying at least one electrical conductor on which the contact area is disposed.

3. The connector according to claim 1, wherein the first and second flexible contacts are biased towards one another and the contact areas face one another.

4. The connector according to claim 1, wherein the first contact assembly further comprises a mounting portion for securing the first and second flexible contacts, and each of the first and second flexible contacts comprises a bump that is used to secure the flexible contact to the mounting portion.

5. The connector according to claim 4, wherein the first and second flexible contacts are sandwiched within the mounting portion.

6. The connector according to claim 1, wherein each of the first and second flexible contacts has an alignment hole to provide for alignment during fabrication.

7. The connector according to claim 1, wherein each of the first and second flexible contacts is attached to a flexible cable at the end of the flexible contact opposite the contact area.

8. The connector according to claim 1, further comprising a plurality of first flexible contacts in parallel with one another and a plurality of second flexible contacts in parallel with one another.

9. The connector according to claim 1, wherein the second contact assembly further comprises a housing.

10. The connector according to claim 9, wherein the flexible contact in the second contact assembly has an undercut to trap the flexible contact in the housing.

11. The connector according to claim 9, wherein the housing of the second contact assembly has a slot for receiving the first contact assembly to form a subassembly.

12. The connector according to claim 11, wherein the subassembly is disposed within the outer housing.

13. The connector according to claim 1, further comprising a plurality of first and second contact assemblies disposed in a row in the outer housing.

14. The connector according to claim 1, wherein the end of the flexible contact nearest the contact area in the second contact assembly is one of U shaped, V shaped, and hook shaped.

15. A connector comprising:

a first contact assembly comprising a first flexible contact and an opposing second flexible contact, each flexible contact having a contact area towards one end of the flexible contact that is electrically connectable with associated electrically conductive pads on a circuit board;

a second contact assembly comprising a flexible contact having a contact area at one end thereof for electrically connecting with an associated electrically conductive pad on the circuit board; and an outer housing for accepting the first contact assembly and the second contact assembly, the outer housing having an aperture at one end to receive the circuit board containing electrically conductive pads and through holes along one surface through which the ends of the flexible contacts away from the contact areas extend perpendicularly.

16. The connector according to claim 15, wherein the first and second flexible contacts are interleaved.

17. The connector according to claim 15, wherein the first and second flexible contacts are disposed in a side-by-side arrangement.

18. The connector according to claim 15, wherein the contacts are releasably connectable to the circuit board via the through holes.

19. The connector according to claim 15, wherein each of the first and second flexible contacts comprises a flexible substrate carrying at least one electrical conductor on which the contact area is disposed.

20. The connector according to claim 15, wherein the first and second flexible contacts are biased towards one another and the contact areas face one another.

21. The connector according to claim 15, wherein the first contact assembly further comprises a mounting portion for securing the first and second flexible contacts, and each of the first and second flexible contacts comprises a bump that is used to secure the flexible contact to the mounting portion.

22. The connector according to claim 21, wherein the first and second flexible contacts are sandwiched within the mounting portion.

23. The connector according to claim 15, wherein each of the first and second flexible contacts has an alignment hole to provide for alignment during fabrication.

24. The connector according to claim 15, wherein each of the first and second flexible contacts is attached to a flexible cable at the end of the flexible contact opposite the contact area.

25. The connector according to claim 15, further comprising a plurality of first flexible contacts in parallel with one another and a plurality of second flexible contacts in parallel with one another.

26. The connector according to claim 15, wherein the second contact assembly further comprises a housing.

27. The connector according to claim 26, wherein the flexible contact in the second contact assembly has an undercut to trap the flexible contact in the housing.

28. The connector according to claim 26, wherein the housing of the second contact assembly has a slot for receiving the first contact assembly to form a subassembly.

29. The connector according to claim 28, wherein the subassembly is disposed within the outer housing.

30. The connector according to claim 15, further comprising a plurality of first and second contact assemblies disposed in a row in the outer housing.

* * * * *